United States Patent [19]

Becher

[11] 4,011,881

[45] Mar. 15, 1977

[54] LARGE SHELTER STANDING UMBRELLA

[75] Inventor: Klaus Becher, Gummersbach, Germany

[73] Assignee: Carl Becher oHG Planen-und Zelte-Fabrik, Gummersbach, Germany

[22] Filed: Aug. 26, 1975

[21] Appl. No.: 607,798

[30] Foreign Application Priority Data

Aug. 31, 1974 Germany ..... 2441817
July 24, 1975 Germany ..... 2533049

[52] U.S. Cl. ..... 135/20 M; 135/2; 135/27; 135/34; 135/36 F; 135/DIG. 8; 135/66

[51] Int. Cl.[2] ..... A45B 19/04; A45B 25/14; A45B 25/18

[58] Field of Search ..... 135/2, 20 M, DIG. 8, 135/7.1 R, 34, 26

[56] References Cited

UNITED STATES PATENTS

| | | | |
|---|---|---|---|
| 299,769 | 6/1884 | Ferrell | 135/2 |
| 1,492,725 | 5/1924 | Henry | 135/34 |
| 1,693,536 | 11/1928 | Woodley | 135/34 |
| 2,598,687 | 6/1952 | Griffin | 135/34 |
| 2,747,591 | 5/1956 | Ogden | 135/20 M |
| 3,841,343 | 10/1974 | Seitel | 135/20 R |
| 3,870,062 | 3/1975 | Medlin | 135/20 M |

*Primary Examiner*—Andrew V. Kundrat
*Assistant Examiner*—Conrad L. Berman
*Attorney, Agent, or Firm*—Diller, Brown, Ramik & Wight

[57] ABSTRACT

This disclosure relates to a large shelter standing umbrella including a tubular support having upper and lower end portions, a slide member in telescopic relationship with said tubular support, rack and pinion means for elevating and lowering the slide member relative to the tubular support, spokes pivotally connected at one end thereof to an upper end portion of the slide member and supporting struts pivotally connected at opposite ends to said spokes and said tubular support.

13 Claims, 13 Drawing Figures

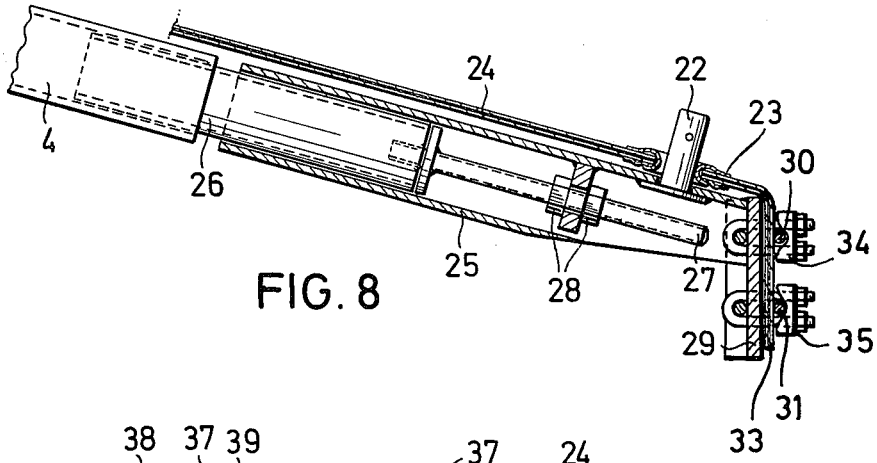
FIG. 8
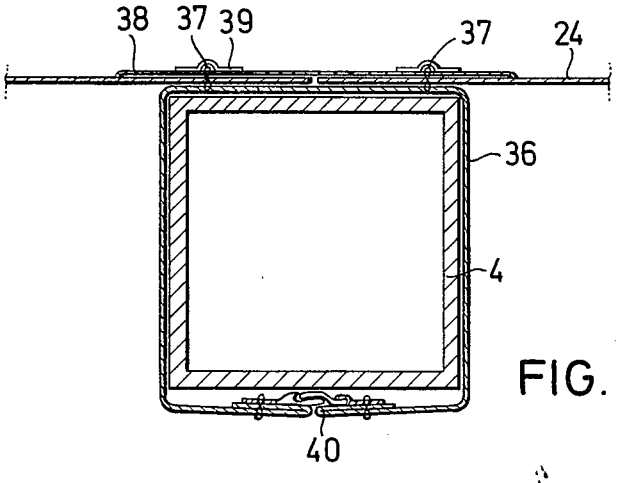
FIG. 10
FIG.9
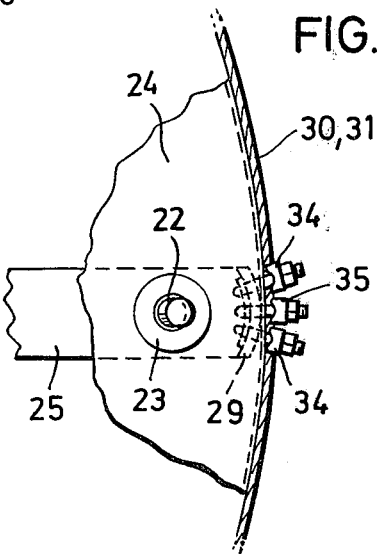

LARGE SHELTER STANDING UMBRELLA

The present invention is directed to a standing umbrella and more particularly a large shelter standing umbrella which may be employed, for example, to cover market areas, terraces, exhibition areas at fairs or the like.

Standing umbrellas of the type to which this invention is directed generally include a tubular support, cover spokes and struts arranged in a manner corresponding to the usual garden umbrellas with the spokes and struts generally being hinged or pivoted to the support tube in one fashion or another. It is known in this respect for the struts to be pivotally connected to a slide member which is displaceable along the support tube while the cover spokes are pivoted on an upper end of the support tube with the struts being pivotally connected between the spokes and the slide member. The opening and closing of such an umbrella is generally effected by the slide member being shifted along the support tube by hand or by means of a crank and some type of a transmission mechanism.

It is a primary object of the present invention to provide a large shelter standing umbrella which makes possible mechanical actuation for elevating and lowering purposes within small space requirements and in a manner in which the elevating and lowering device is inconspicuously arranged in an aesthetic fashion.

In keeping with a further object of this invention the spokes of the umbrella are provided with upstanding projections which engage the periphery of an umbrella cover such that in the closing operation the periphery of the cover remains above a horizontal plane taken through the end points of the spokes.

In further accordance with this invention, the support tube has upper and lower end portions with the spokes being pivotally connected to an upper end portion of a tubular slide member received within the upper end portion of the tubular support, and the mechanism for elevating and lowering the slide mechanism or slide member being positioned at the upper end portion of the support tube.

In keeping with the objects heretofore discussed a combination of advantages are achieved such as enabling the umbrella to be used for covering large areas while being reliably and safely opened and closed. In addition, a comparatively small height is utilized during the opening and closing operations and additionally the cover spokes do not reach below the height of ends of the opened umbrella during the closing operation, and as a consequence the umbrella can be opened and closed in the absence of excessive cover space beneath the height of the end points of the cover spokes. Thus, should people be in the area of the umbrella they need not be disturbed during the opening and closing thereof. Thus, a certain low position of the umbrella is produced in the opened state so that the stability of the umbrella against the effects of high winds is substantially improved yet no undersired change in effective height is created when either the closed or opened condition of the umbrella must be altered. The structural parts of the umbrella, and particularly the support tube, need not be over-engineered or dimensioned and a mechanical actuating device makes possible a direct engagement with the slide member or lifting tube without additional transmission elements, such as linkages, wires, cables or the like.

Since the standing umbrella in the closed position assumes a height which is greater than when the umbrella is in its opened position, the umbrella can assume a height in its closed position which is substantially at the low height of the umbrella in its opened position. This is achieved by the use of a flange ring or sleeve carried by the tubular support and having pivotally connected thereto the struts extending from the spokes with the ring or sleeve being displaceable toward the lowermost end portion of a support tube in the closed position of the umbrella. In this way, the umbrella frame formed of the slide member or lift tube, the cover spokes and the struts can in the closed position be lowered as a unit along and relative to the support tube. The standing umbrella in the closed state thereby assumes substantially a lower height as compared with the height which is necessary in order to convert the umbrella from the opened position into the closed position. Depending on the length ratios of the support tube and the lifting tube or slide member, the result is obtained that in the lower state of the umbrella the latter assumes a height which is scarcely greater than the height of the umbrella in the opened state. The lowering of the umbrella frame in the closed state can be effected because of its own weight or also by means of the elevating and lowering mechanism which is operative upon the lifting tube or slide member.

The spokes of the umbrella are of an arcuate configuration so that the ends of the spokes in the closed state bear tightly against the support tube and the spokes can thus accommodate within their closed configuration the elevating and lowering mechanism. The latter mechanism is preferably carried by a flange plate carried by an upper end portion of the support tube. The flange plate thus not only serves as a support for the lifting and lowering mechanism but also serves as an abutment surface for a compression spring which provides a damping action during the end travel of the umbrella during the closing operation.

In further accordance with this invention, the lifting and lowering mechanism is preferably in the form of a geared braking motor driving a pinion gear in mesh with a rack disposed longitudinally upon the slide member or lifting tube. Though the gear braking motor is electrically driven a conventional mechanism which operates under pneumatic or hydraulic means may be utilized.

In further accordance with this invention, the lifting tube or slide member also includes at least one longitudinally extending rib, strip or guide which is cooperative with bearing means in the tubular support or support tube such that the lifting tube or slide member can be lowered or elevated without twisting, thereby guaranteeing safe and reliable guiding motion during opening and closing operations.

Preferably, the cover of the umbrella is secured to the cover spokes by providing the latter with upstanding pins or bolts engaged by suitable thimbles or openings in the periphery of the umbrella cover. Preferably, a terminal and portion of each of the spokes is adjustable and can be secured in any adjusted position so as to be able to produce a stretching or tensioning of the cover along the spokes. This achieved in accordance with a preferred embodiment of this invention by means of a threaded stud fixed to each spoke and an end portion slidably receiving the threaded stud to which a periphery of the cover is connected. Thus, as the end portion is moved along the threaded stud the cover may be tensioned or loosened, as may be desired.

In further accordance with this invention, the umbrella cover is provided with a plurality of tubular sleeves which are suitably fastened to the cover and can telescopically receive the umbrella spokes. However, in order to permit the cover to be readily applied to and removed from the spokes the sleeve is provided with means which divide the same lengthwise in order that the tubular sleeves can be each totally opened and closed by, for example, a zipper, a plurality of fasteners, or similar clamping devices to insure that the cover can be connected in a simple though totally reliable manner to each cover spoke and given satisfactory support thereby.

In order to assure that the umbrella cover remains taut between adjacent spokes when the umbrella is in its opened position, the ends of the spokes are provided with means for engaging ropes, cords, or cables which are in turn connected to peripheral margins of the cover. Thus, if the cover is tensioned in any fashion, the ropes, cords or cables prevent the same from "riding up" along the spokes, and the peripheral edge of the cover is thereby held as closely possible to terminal ends of the spokes to assure a relatively taut cover when in its opened position, which also contributes in adherent force against the spokes during a closing operation.

With the above and other objects in view that will hereinafter appear, the nature of the invention will be more clearly understood by reference to the following detailed description, the appended claimed subject matter, and the several views illustrated in the accompanying drawing.

IN THE DRAWINGS

FIG. 8 is a fragmentary cross-sectional view of an end portion of one of the spokes of the umbrella, and illustrates a mechanism for altering the length of the spoke, a fastening pin for the cover, and means for clamping cover cables thereto.

FIG. 9 is a fragmentary sectional view looking downwardly in FIG. 8 and illustrates details of the arrangement of the latter Figure.

FIG. 10 is a sectional view taken through one of the spokes, and illustrates a tubular sleeve which is secured to the cover, surrounds the spoke, and can be totally longitudinally separated along the length thereof.

Figure 1:
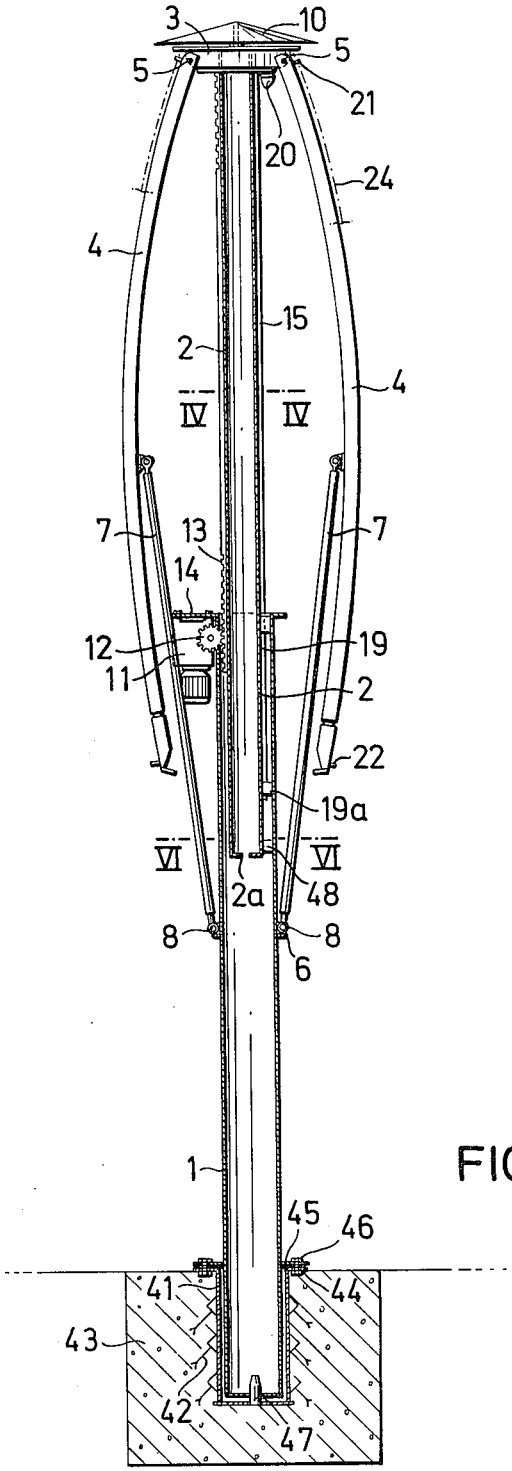
FIG. 1 is a vertical sectional view partially in elevation of a novel standing umbrella constructed in accordance with this invention and illustrates interengaged rack and pinion means for elevating and lowering a slide member or lifting tube relative to a support tube for opening and closing the umbrella cover.
Figure 2:
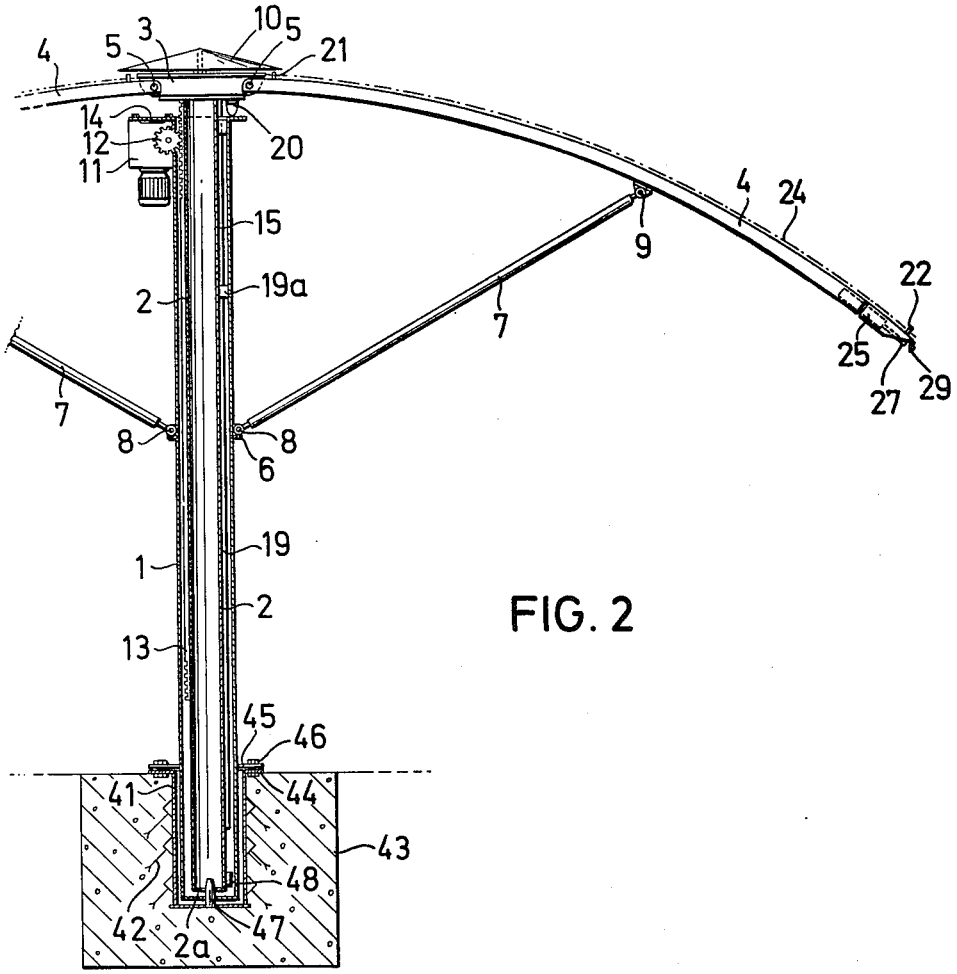
FIG. 2 is a fragmentary side elevational view partially in cross-section, similar to FIG. 1, and illustrates the umbrella in its fully opened condition.
Figure 3:
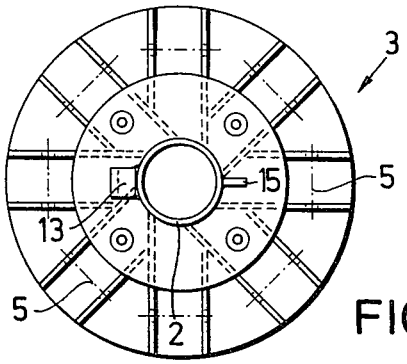
FIG. 3 is a view looking upwardly of a head carried by the lifting tube or slide member to which the spokes are pivotally connected.
Figure 4:
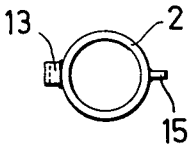
FIG. 4 is a cross-sectional view taken along line IV—IV of FIG. 1, and illustrates a guide rib and a rack carried by the lifting tube.

A novel large shelter standing umbrella constructed in accordance with this invention is illustrated best in its totality of FIGS. 1 and 2 and includes a support or support tube 1 of a tubular configuration having upper and lower end portions (unnumbered) in which is telescopically received a lifting tube or slide member 2, also having unnumbered upper and lower end portions. The slide member or lifting tube carries at its upper end portion a head member 3 to which is pivotally connected ends of cover spokes 4 by transverse pins or bolts 5. The spokes 4 are of an arcuate predetermined configuration bowing downwardly in the opened position thereof, as is best illustrated in FIG. 2. The spokes 4 are preferably of a hollow rectangular cross-sectional configuration (FIG. 10) and are pivotally connected to struts 7 which are in turn pivotally connected to a flange ring 8 in external slidable displaceable relationship to the support tube 1. The pivotal connection between each strut 7 and its associated spoke 4 is designated by the reference numeral 9. The struts 7 are also preferably of a hollow cross-section and may be circular or rectangular, much in the same manner as the cross-sectional configuration of the spokes 4 shown best in FIG. 10. Preferably, the spoke head 3 is covered by a protective cover 10, which is connected in any conventional manner to the head member 3 or the upper end portion (unnumbered) of the lifting tube or slide member 2.

Figure 5:
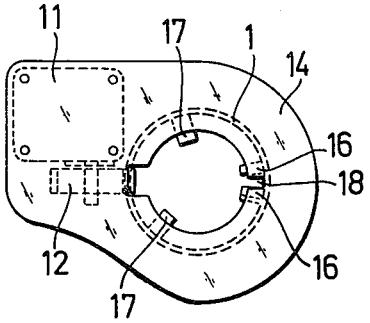
FIG. 5 is a top plan view of an uppermost terminal end of the support tube, and illustrates a plate secured thereatop provided with an opening for the lifting tube and bearing or guide means for the rib of the latter.
Figure 6:
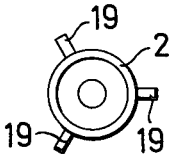
FIG. 6 is a cross-sectional view taken along line VI—VI of FIG. 1, and illustrates a plurality of ribs carried by the lifting tube or slide member.
Figure 7:
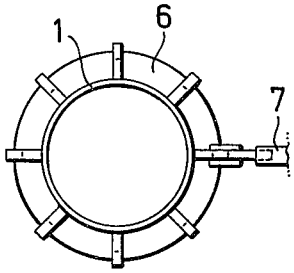
FIG. 7 is a plan view of a flange ring carried in external sliding relationship to the support tube.

Means for lifting and lowering the slide member 2 relative to the support tube 1 is generally designated by the reference numeral 11 and is preferably a geared braking motor having a shaft (unnumbered) carrying a pinion gear 12 in mesh with a rack 13 disposed lengthwise of the slide member 2 and fixed to the latter. The lifting and lowering mechanism 11, 12 is carried by a flange plate 14, best shown in FIG. 5 suitably secured to the upper end portion of the support 1. The flange plate 14 projects beyond the outer peripheral diameter of the support tube 1 and is designed to provide a guide bearing for at least one guide rib or strip 15 fixed to and running longitudinally of the length of the slide member 2 or at least over the length of the upper end portion thereof. The lifting tube or slide member 2 is guided adjacent the flange plate 14 by means of guide bearings 16, 17 with the guide bearings forming between them a slot 18 in which is engaged the guide rib 15 of the lifting tube 2. The lower end portion of the lifting tube 2 is preferably provided with additional guide ribs 19 (FIG. 6) which cooperate with guide bearings 19*a* fixed to the inner side of the support tube 1, in the manner best illustrated in FIGS. 1 and 2 of the drawings.

The geared brake motor 11 is constructed in a known manner such that it can stop the movement of the lifting tube 2 at any particular position and can by its own internal construction hold the position of the lifting tube 2 relative to the support tube 1. Preferably the spoke head 3 is provided on its underside with at least one damping spring 20 which projects downwardly and may, for example, be in the form of a compression spring, for engaging the flange plate 14 at the determination of the lowering operation of the lifting tube 2. Preferably the biasing means, compression spring, or parabolic springs 20 cooperate with limit switches (not shown) which are arranged on the flange plate 14 for cutting off the braking motor 11 when the lifting tube 2 is fully descended into the support tube 1 in the manner shown in FIG. 2. The geared brake motor 11 is also operative in the event of the failure in current (the umbrella can neither be opened nor closed) or if the umbrella is actually moving when the current failure occurs, movement is stopped and the corresponding intermediate position of the lifting tube 2 relative to the support tube 1 is held immobile. The same also applies should there by an overload or phase failure during the operation of the motor 11.

The spokes 4 are provided with terminal end portions 25, 26 (FIG. 8) in telescopic relationship to each other with a portion 25 carrying pins or bolts 22 which project upwardly and engage in thimbles or grommets 23 of a cover 24 of the umbrella. Like pins 21 may be provided at opposite ends of the spokes in the manner illustrated in FIG. 2. Threaded studs 27 are fixed to each of the end portions 26 and freely pass through apertured brackets (unnumbered) welded to the end portions 25, with nuts 28 being disposed at each side of the latter-mentioned brackets, in the manner best shown in FIG. 8. Thus, it is readily apparent that the end portion 25 of each strut 4 can be moved relative to the end portion 26 and fixed at any desired location by altering the position of the nuts 28 thereby tensioning or untensioning the cover 24.

Each end portion 25 of each spoke 4 is provided with a bent-over holder member 29 carrying clamp means in the form of U-bolts and nuts, collectively designated by the reference numerals 34 and 35, which clamp thereto ropes or cables 30, 31 respectively, fixed to peripheral end portions 33 of the cover 24. The peripheral dimension of the ropes 30, 31 is such that they will be in tension in the fully opened position (FIG. 2) of the umbrella such that the cover 24 is always stretched or taut when opened. At the same time, because of the tensioning of the ropes 31, 32 the umbrella is under an inherent force which causes an automatic upward movement of the lifting tube or slide member 2 upon the beginning of a closing operation.

The umbrella cover 24 is preferably connected to each spoke 4 over a part but preferably the entire length of the latter. For this purpose each spoke 4 is enclosed by a tubular sleeve 36 suitably fastened thereto by an upper side by conventional connecting seams 37, connecting strips 38, and cover bands 39. Each tubular sleeve 36 is divided longitudinally along its underside along its entire length with the longitudinal edges of each tubular sleeve 36 being fastened to each other by a zipper, individual fasteners, or any conventional slide clasp fastener 40. In this manner, the cover can be readily applied to and removed from each of the spokes 4 by respectively closing and opening the tubular sleeves 36. Preferably woven synthetic plastic material is utilized as the umbrella cover and its sleeves, such as polyvinyl chloride coated polyester fabric.

The support tube 1 can be anchored in various ways to a suitable support and advantageously a lower end portion (unnumbered) thereof is received in a tubular base 41 embedded by means of anchors 42 in a concrete foundation 43. The base tube 41 has a ring flange 44 on which is adapted to bear a ring flange 45 fixed to the lower end portion of the support tube 1. The ring flanges 45, 44 are secured to each other by screws and bolts, collectively designated by the reference numeral 46.

A centering pin 47 is preferably carried by the bottom of the base tube 41 over which engages the support tube 1. The centering pin 47 is preferably made sufficiently long for the lifting tube 2 also to engage over the centering pin 47 with a closed bottom portion **2*a* thereof (FIG. 2) when the lifting tube 2 is in its lowermost position. In addition, slide bearing blocks 48 (FIG. 2) are arranged along the circumference at the bottom end of the lifting tube 2 so that the bottom end of the lifting tube 2 is at any time radially guided in the support tube 1**.

During the opening operation of the umbrella from the position shown in FIG. 1 to that shown in FIG. 2, the geared braking motor 11 is energized causing rotation of the pinion gear 12 which in turn operates the rack 13 to lower the lifting tube 2 to the position shown in FIG. 2, at which time the damping spring members 20 prevent undesired contact between the flange 14 and the head 3 and also switching off the motor 11. Since the motor 11 is a geared braking motor there is obtained at the same time a locking of the elements 2, 1, relative to each other.

In order to close the umbrella, the lifting tube 1 is driven upwardly by a reversing of the geared braking motor, but should any position of relative motion between the elements 1, 2 be reached between full closing (FIG. 1) any such interruption in relative positions will be maintained by the geared braking motor 11.

Preferably the cover 24 of the umbrella is circular but it may also be of a square or rectangular configuration and is designed for covering large areas, for example, areas up to 250 to 300 meters squared and even more. When several such umbrellas with rectangular surface areas of the tension covers are arranged side-by-side it is possible to erect more or less hall-like covers or shelters which require only a few supporting points and can be shifted by simple means.

Figure 11:
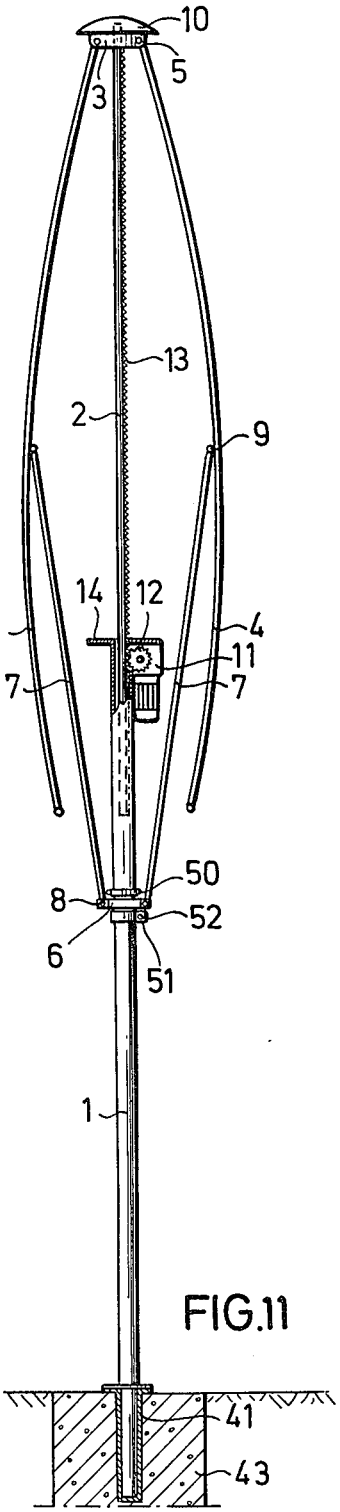
FIG. 11 is a side elevational view partially in cross-section of another umbrella constructed in accordance with this invention, and illustrates the same in its closed position with a slide member, sleeve or collar in its uppermost position.

In order that the standing umbrella in its closed position can be brought to a low height by being lowered the flange ring 6 which accommodates the struts 7 is displaceably mounted on the support tube 1 and in fact at a predetermined height between the terminal end portions of the support tube with this height being disposed approximately in the middle of the support tube 2. The latter position may obviously be altered and may be provided up to approximately the upper quarter or third of the length of the support tube 1. It is also, of course, desirable to immovably to fix the flange ring 6 to the support tube 1 and in order to accomplish this there is provided stop means, fixing means or abutment means 50 best shown in FIGS. 11 and 12 consisting of a ring adjustably fixed to the support tube 1.

Figure 12:
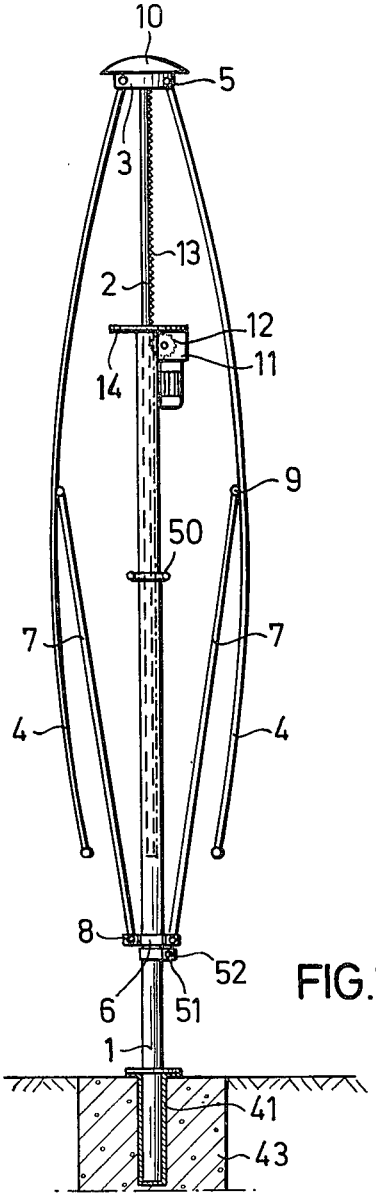
FIG. 12 is a view similar to FIG. 11 showing the umbrella in its closed and lowermost position.

Any suitable clamping means may be carried by the support ring 51 to clamp the same at any position desired along the support tube 1 beneath the fixed stop ring 50. For example, in FIG. 11 the clamping ring 51 is initially position at a high elevation and fixed thereat and my be unfixed and lowered as shown in FIG. 12, but preferably the fixed ring 50 remains immovable at the position illustrated in both FIGS. 11 and 12 and thus remains unchanged in its position along the support tube 1 during the opening and closing of the umbrella. A conventional wing nut 52 may be utilized in conjunction with the ring 51, which may be simply a split ring, for achieving the different positions of clamping fixation to the support tube 1. If then the lifting tube 2 together with the umbrella parts in the closed position is moved in the direction of the ground by means of the elevating means 11 the closed umbrella is correspondingly lowered until the flange ring 6 strikes against the support ring 51 which is fixed on the support tube 1. Depending on the height of the support tube 1, the standing umbrella is then able in the closed position to have an overall height which does not differ substantially from the height of the umbrella in the opened position and can even correspond exactly to the latter height or any intermediate position is obviously possible in this way.

In order to open the umbrella from its closed position the lifting tube 2 is initially raised until the flange ring 6 bears against the stop 50 after which the support ring 51 on the support tube 1 is shifted upwardly and immediately stopped and fixed on the support tube 1 beneath and directly against the flange ring 6, which, in turn bears against the stop ring 50. In this way, the umbrella has reached its starting position for the opening movement. If, thereafter, the lifting tube 2 is once again moved into the support tube 1 by means of the motor 11, the umbrella is opened by spreading of the cover spokes 4 through the struts 7 while the flange ring 6 remains immovable on the support 1 whereby the clamp 51 is immobilized.

Figure 13:
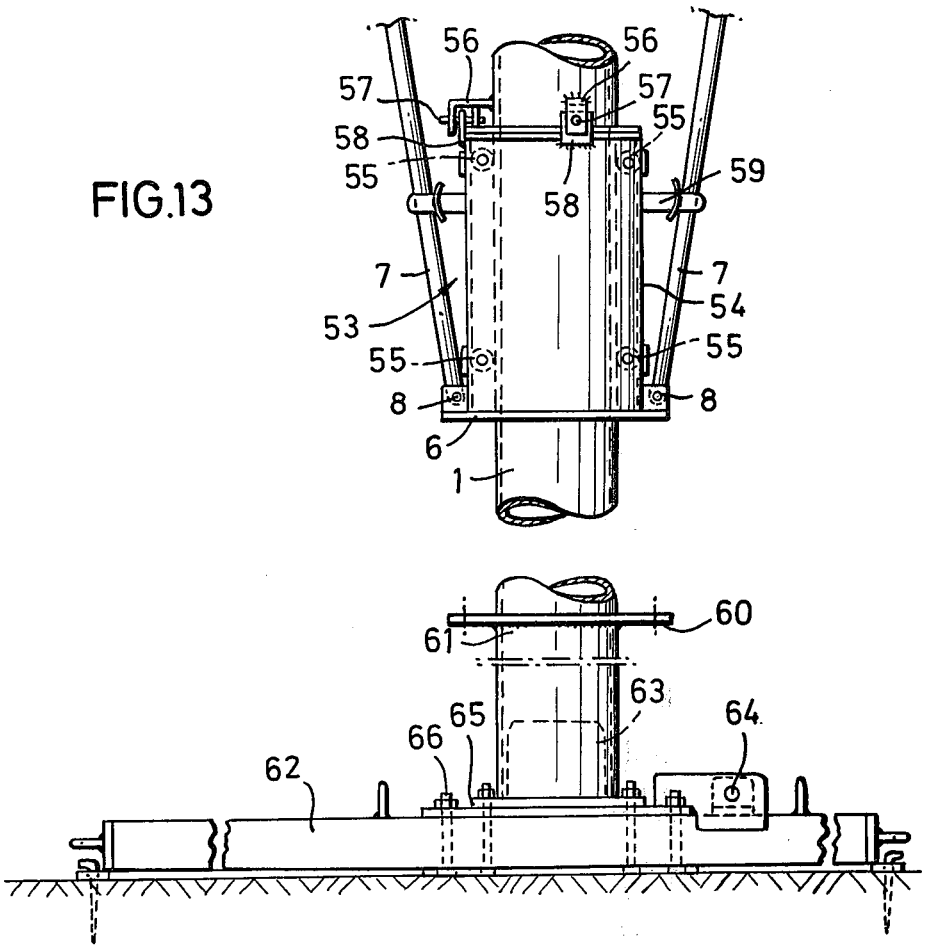
FIG. 13 is a fragmentary side view of another umbrella construction of this invention, and illustrates a sleeve to which are pivotally mounted struts with the sleeve being limited to its movement between upper and lower fixed limits and locked to the upper limits by pin and aperture connections.

Reference is now made to FIG. 13 of the drawings, which illustrates an alternative embodiment of the invention relative to the manner in which a flange ring or sleeve 53 can move relative to the support tube 1 between upper and lower limits. In this case, the sleeve 53 includes a tubular housing 54 carrying rollers 55 which ride against the exterior surface of the support tube 1. Fixed stop means 56, in the form of plates, are welded to the tube 1, and are apertured as are plates 58 carried by the sleeve 53 with pins 57 passing through the apertures of the plates 56, 58, in the manner shown in FIG. 13 to lock the sleeve 53 relative to the support tube 1 in the uppermost position of the sleeve 53. in this way, the sleeve 53 is held fast to the support tube 1 in its uppermost position. However, after releasing the pins or bolts 57 with the umbrella parts in their closed position the same can be lowered by means of the means 11 a predetermined distance so that the overall height of the closed umbrella is substantially reduced. In the lowered position of the umbrella parts in the closed state both the flange ring and the sleeve can be anchored fast to the support tube 1 by means of screws or bolts 60 passing through apertures (unnumbered) of a plate 61 fixedly secured to a lower end portion of the support tube 1. The reference numeral 59 represents limit stops for the struts 7 in the closed position of the umbrella parts.

The lowering of the umbrella which is in the closed position can also be effected because of the inherent weight of the umbrella in the closed position. For this purpose it is merely necessary to break the connection of the motor 11 with the lifting tube 2 by means of an appropriate clutch or for the motor to be switched over to a neutral position. For raising the umbrella frame, when it is in the closed position, the geared motor is preferably used as a lifting motor.

Obviously, in lieu of a concrete foundation it is also possible to employ a base plate 62 (FIG. 13) provided with a centering pin 63 for receiving the lower end portion of the support tube 1. Additionally, the lower end portion of the support tube 1 can be pivotally mounted upon the base plate by a pivot pin 64. The anchoring of a foot plate 65 to the base plate 62 may be preferably effected by conventional screws and bolts 66 distributed about the circumference.

While preferred forms and arrangement of parts have been shown in illustrating the invention, it is to be clearly understood that various changes in details and arrangement of parts may be made without departing from the scope and spirit of this disclosure.

I claim:

1. A large shelter standing umbrella comprising a tubular support having upper and lower end portions, a slide member having upper and lower end portions, means mounting said slide member for internal telescopic reciprocal movement relative to said tubular support, a plurality of spokes pivoted at one end to the upper end portion of said slide member, a plurality of struts each pivoted at one end to an associated one of said spokes and at another end being pivotally connected to said tubular support, means carried by said support upper end portion for elevating and lowering said slide member relative to said support, said elevating and lowering means including a gear, said gear being in mesh with a longitudinally extending radially outwardly projecting toothed rack carried by said slide member, guide means internally of said tubular support for axially guiding the reciprocal movement of said slide member and limiting rotational motion thereof relative to said tubular support, and said guide means include a radially inwardly opening groove carried by said tubular support corresponding in cross section to that of said toothed rack.

2. The umbrella as defined in claim 1 including a radially outwardly directed plate carried by the upper end portion of said tubular support, and said elevating and lowering means are carried by said plate.

3. A large shelter standing umbrella comprising a support having upper and lower end portions, a slide member having upper and lower end portions, means mounting the upper end portion of said support and the lower end portion of said slide member for relative sliding movement, a plurality of spokes pivoted at one end to the upper end portion of said slide member, a plurality of supporting struts each pivoted at one end to an associated one of said spokes and at another end being pivotally connected to said support, means carried by said support upper end portion for elevating and lowering the slide member relative to the support, and spring means disposed between the upper end portions of said support and slide member for resiliently supporting the latter in the fully lowered position of said slide member relative to said support.

4. A large shelter standing umbrella comprising a support having upper and lower end portions, a slide member having upper and lower end portions, means mounting the upper end portion of said support and the lower end portion of said slide member for relative sliding movement, a plurality of spokes pivoted at one end to the upper end portion of said slide member, a plurality of supporting struts each pivoted at one end to an associated one of said spokes and at another end being pivotally connected to said support, means carried by said support upper end portion for elevating and lowering the slide member relative to the support, second ends of said plurality of spokes remote from said first ends of said plurality of spokes being mounted for adjusting movement toward and away from said spoke one ends thereby adjustably varying the length of the individual spokes, each of said spoke second ends having a downwardly directed portion, a cover overlying said spokes, said cover having a peripheral edge overlying said downwardly directed portions, a pair of bands exteriorly overlying said peripheral edge, and means for clamping said pair of bands to at least selected ones of said downwardly directed portions.

5. The umbrella as defined in claim 4 wherein said bands are under tension.

6. A large shelter standing umbrella comprising a support having upper and lower end portions, a slide member having upper and lower end portions, means mounting the upper end portion of said support and the lower end portion of said slide member for relative sliding movement, a plurality of spokes pivoted at one end to the upper end portion of said slide member, a plurality of supporting struts each pivoted at one end to an associated one of said spokes and at another end being pivotally connected to said support, means carried by said support upper end portion for elevating and lowering the slide member relative to the support, a cover overlying said spokes, said cover having an outermost peripheral portion, a plurality of generally tubular sleeves carried by said peripheral portion, a spoke received in each sleeve, and means for uniting and separating each tubular sleeve longitudinally of itself for readily encasing or releasing each spoke.

7. A large shelter standing umbrella comprising a support having upper and lower end portions, a slide member having upper and lower end portions, means mounting the upper end portion of said support and the lower end portion of said slide member for relative sliding movement, a plurality of spokes pivoted at one end to the upper end portion of said slide member, a plurality of supporting struts each pivoted at one end to an associated one of said spokes and at another end being pivotally connected to said support, and means carried by said support upper end portion for elevating and lowering the slide member relative to the support, second ends of said plurality of spokes remote from said first ends of said plurality of spokes being mounted for adjusting movement toward and away from said spoke one ends thereby adjustably varying the length of the individual spokes, said second end portions of said spokes having upwardly directed pins, a cover overlying said spokes, said cover having an outermost peripheral portion, apertures in said outermost peripheral portion, and each pin being received in an associated one of said apertures.

8. A large shelter standing umbrella comprising a support having upper and lower end portions, a slide member having upper and lower end portions, means mounting the upper end portion of said support and the lower end portion of said slide member for relative sliding movement, a plurality of spokes pivoted at one end to the upper end portion of said slide member, a plurality of supporting struts each pivoted at one end to an associated one of said spokes, means carried by said support upper end portion for elevating and lowering the slide member relative to the support, a fixed stop carried by said tubular support between the upper and lower end portions thereof, means slidable between said tubular support lower end portion and said fixed stop, said plurality of supporting struts having each another end opposite said supporting struts one end, said another end of each supporting strut being pivotally connected to said slidable means, and means releasably securing said slidable means to said fixed stop.

9. The umbrella as defined in claim 8 wherein said slidable means is a sleeve surrounding said tubular support.

10. The umbrella as defined in claim 8 wherein said releasable securing means is a pin engageable in said fixed stop and slidable means engagable in opening means of said fixed stop and slidable means.

11. The umbrella as defined in claim 9 wherein said releasable securing means is a pin engagable in said fixed stop and slidable means engagable in opening means of said fixed stop and slidable means.

12. The umbrella as defined in claim 10 wherein said opening means is an opening of said slidable means an opening of said slide member, and said pin is releasably engagable in said openings.

13. A large shelter standing umbrella comprising a tubular support having upper and lower end portions, a slide member having upper and lower end portions, means mounting said slide member for internal telescopic reciprocal movement relative to said support, a plurality of spokes pivoted at one end to the upper end portion of said slide member, a plurality of supporting struts each pivoted at one end to an associated one of said spokes and at another end being pivotally connected to said support, means carried by said support upper end portion for elevating and lowering the slide member relative to the support, said elevating and lowering means including a gear, said gear being in mesh with a longitudinally extending radially outwardly projecting toothed rack carried by said slide member, guide means internally of said support for axially guiding the reciprocal movement of said slide member and limiting rotational motion thereof relative to said support, said guide means including a radially inwardly opening groove carried by said support corresponding in cross section to that of said toothed rack, a radially outwardly directed plate carried by the upper end portion of said tubular support, said elevating and lowering means are carried by said plate, second ends of said plurality of spokes remote from said first ends of said plurality of spokes being mounted for adjusting movement toward and away from said spoke one ends thereby adjustably varying the length of the individual spokes, each of said spoke second ends having a downwardly directed portion, a cover overlying said spokes, said cover having a peripheral edge overlying said downwardly directed portions, a pair of bands exteriorly overlying said peripheral edge, means for clamping said pair of bands to at least selected ones of said downwardly directed portions, said bands are under tension, a plurality of generally tubular sleeves carried by said peripheral edge, a spoke received in each sleeve, means for uniting and separating each sleeve longitudinally of itself for readily encasing or releasing each spoke, said second end portions of said spokes having upwardly directed pins, apertures in said cover peripheral edge, each pin being received in an associated one of said apertures, a fixed stop carried by said support between the upper and lower end portions thereof, means slidable between said support lower end portion and said fixed stop, said plurality of supporting struts having each another end opposite said supporting struts one end, said another end of each supporting strut being pivotally connected to said slidable means, and means releasably securing said slidable means to said fixed stop.

* * * * *